US006787977B2

(12) United States Patent
Taguchi et al.

(10) Patent No.: US 6,787,977 B2
(45) Date of Patent: Sep. 7, 2004

(54) ELECTRON GUN FOR CATHODE-RAY TUBE AND METHOD FOR MANUFACTURING THE SAME

(75) Inventors: Yuuji Taguchi, Osaka (JP); Masahiko Konda, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 8 days.

(21) Appl. No.: 10/196,907

(22) Filed: Jul. 16, 2002

(65) Prior Publication Data

US 2003/0015953 A1 Jan. 23, 2003

(30) Foreign Application Priority Data

Jul. 18, 2001 (JP) ..... 2001-217789

(51) Int. Cl.[7] ..... H01J 29/48

(52) U.S. Cl. ..... 313/414; 313/444; 313/451; 445/46

(58) Field of Search ..... 313/414, 417, 313/444, 438, 451, 482, 477 R, 456–460, 421, 426, 427, 441, 238, 258; 445/35, 36, 46

(56) References Cited

U.S. PATENT DOCUMENTS 3,838,306 A * 9/1974 Jenne, Jr. ..... 313/409

6,133,685 A 10/2000 Konda et al.

FOREIGN PATENT DOCUMENTS

| | | |
|---|---|---|
| JP | 61-29047 | 2/1986 |
| JP | 10-74465 | 3/1998 |
| JP | 2000-188067 | 7/2000 |

* cited by examiner

*Primary Examiner*—Ashok Patel
(74) *Attorney, Agent, or Firm*—Merchant & Gould, P.C.

(57) ABSTRACT

Among a plurality of electrodes composing an electron gun, at least one electrode is separated into two along a plane substantially perpendicular to a central axis, the two being a first cylindrical electrode and a second cylindrical electrode. Between the two electrodes, a connecting member in an approximate cylindrical shape having a slit is interposed, which electrically connects the first and second cylindrical electrodes with each other. The first and second cylindrical electrodes are fixed to a support rod via the connecting member and support portions provided on a side of the connecting member. Since a modulation magnetic field from outside a cathode-ray tube passes through the slit, eddy current loss can be reduced, whereby a desired electron beam modulation effect can be achieved. Furthermore, since no slit is formed in the first and second cylindrical electrodes, it is possible to avoid distortion of electrodes that is caused when slits are formed in the electrodes, as well as distortion of an electron lens due to the distortion of the electrodes.

9 Claims, 8 Drawing Sheets

(VI)

(VII)

ELECTRON GUN FOR CATHODE-RAY TUBE AND METHOD FOR MANUFACTURING THE SAME

BACKGROUND OF THE INVENTION

1. Field of the Invention

The present invention relates generally to an electron gun for a cathode-ray tube, and particularly relates to a technique for improving high-frequency magnetic-field-transmittance characteristics of the electron gun.

2. Related Background Art

FIG. 14 is an enlarged cross-sectional view of a neck tube portion of a projection-type monochrome cathode-ray tube.

As shown in FIG. 14, magnetic field modulation is applied to an electron gun provided inside the neck tube 3 from outside the neck tube 3 by velocity modulation coils 20, to carry out the so-called velocity modulation of an electron beam so as to improve the focusing performance. This is the current advanced display technique (JP 10(1998)-74465 A). While an electron beam (not shown) is emitted from a cathode 7 and reaches a phosphor screen surface (not shown), the path of the electron beam is modulated by an alternate magnetic field generated by the velocity modulation coils 20, convergence yokes 23, deflection yokes 24, and the like.

The deflection yokes 24 are attached to a cathode-ray tube funnel cone portion, and generate an alternate magnetic field to deflect the electron beam path, so as to scan the cathode-ray tube phosphor screen surface with the electron beam. The convergence yokes 23 are attached to the outside the neck tube 3 of the cathode-ray tube, and generate an alternate magnetic field to deflect an electron beam path, so as to correct raster distortions and color shifts. The velocity modulation coils 20 are attached to the outside of the neck tube 3 of the cathode-ray tube, and generate an alternate magnetic field to modulate a scanning velocity of the electron beam, so as to prevent a high-brightness portion from extending off into a low-brightness portion on the phosphor screen surface, thereby obtaining sharp images.

A frequency of the alternate magnetic field for modulating an electron beam ranges from a deflection frequency (15.75 [kHz]) to a megahertz order equal to a level of picture frequencies. Therefore, there is a drawback in that the alternate magnetic field is attenuated by metal components of the electron gun that are formed by deep-drawing or the like with a metal material such as stainless steel, with the result that a desired electron beam modulation cannot be achieved.

As shown in FIG. 14, a part of the alternate magnetic field 19 generated by the deflection yokes 24 passes through a second anode electrode 11 (G5 electrode). An alternate magnetic field 22 generated by the convergence yokes 23 passes through the second anode electrode 11. The velocity modulation coils 22 are disposed between a first anode electrode 9 (G3 electrode) and a convergence electrode 10 (G4 electrode), and an alternate magnetic field 21 (at a level of 4 [MHz]) generated by the velocity modulation coils 20 passes through the first anode electrode 9 and the convergence electrode 10. When the alternate magnetic fields are applied to the electron beam via these metal electrodes, an eddy current is generated in part of the metal electrodes. Furthermore, as the frequencies of the alternate magnetic fields increase, loss of the alternate magnetic fields due to the eddy current increases. Therefore, the effect of the electron beam path modulation by the magnetic fields reduces in a high frequency range for the modulation.

A technique to solve such a problem is disclosed by JP 2000-188067 A. In the technique, an electron gun includes a G1 electrode that houses a cathode, a G2 electrode, a G3 electrode, a G4 electrode, and a G5 electrode that are arrayed in the stated order, the G3 electrode and the G4 electrode together forming a main electron lens. In the electron gun, a coil-shaped part is provided in a part of the G3 electrode so that a velocity modulation magnetic field passes therethrough, thereby reducing eddy current loss. Besides, the JP 61(1986)-29047 A discloses a technique of providing a plurality of slits on a circumferential surface portion of a cylindrical part of a bottomed cylindrical converging magnetic pole that is made of a nonmagnetic substance and that is attached to an electron-beam-emitting tip of an in-line-type electron gun, so as to prevent eddy current loss generated by a magnetic field that passes through the circumferential surface portion of the cylindrical part.

However, in the case where a technique of providing slits as taught by JP 61(1986)-29047 A is applied to an electron gun for forming an electron lens between bottomless cylindrical electrodes, the electrodes are deformed when slits are formed in cylindrical metal members. As a result, the electron lens formed between the electrodes has distortion, thereby being unable to achieve a desired effect of conversion of the electron beam having passed through the electron lens. Therefore, an electron beam spot observed on the phosphor surface has a deformed shape, thereby adversely affecting the resolution. Normally, in the case of cylindrical electrodes, when the electrode roundness thereof is lower than 99.8[%], the distortion of the electron lens apparently affects the electron beam spot. If slits are provided in the cylindrical electrode, the roundness of the electrode is impaired to 97 to 98%, thereby making the electrode unsuitable for practical application. In this case of a coil-shaped electrode taught by JP 2000-188067 A, it is not easy to form the coil so that it has a roundness of not less than 99.8[%], and in addition, a problem also arises in that the coil itself slightly hangs down due to the gravity. Therefore, it is impossible to avoid the problem of distortion of the electron beam spot shape caused by the deterioration of the roundness of the electrode.

SUMMARY OF THE INVENTION

The present invention is made to solve the foregoing problems, and it is an object of the present invention to provide a high-resolution electron gun for a cathode-ray tube with decreased resolution variation, which achieves a desired electron beam modulation effect without hindering the penetration of a modulation magnetic field from outside, and does not generate distortion of an electron lens due to distortion of an electrode, thereby obtaining an excellent beam spot shape.

An electron gun for a cathode-ray tube according to the present invention includes a plurality of cylindrical electrodes arranged so that an electron beam passes inside the electrodes, the electrodes being fixed to a support rod. In the electron gun, at least one of the electrodes is separated into at least two pieces along a plane substantially perpendicular to a central axis of the electrode, and a connecting member having a slit is provided between the pieces of the separated electrode. The pieces of the separated electrode are in electrical contact with each other via the connecting member, and are fixed to the support rod via the connecting member and support portions provided on a side of the connecting member.

The foregoing configuration reduces eddy current loss, since the modulation magnetic field passes through the slit provided in the connecting member. Furthermore, the electrode forming an electron lens at an end is configured so that the electrode is divided into at least two pieces and the connecting member with the slit is interposed between the two pieces. Therefore, it is possible to avoid a problem in that an electrode is deformed when the slit is formed in the electrode, and hence, it is possible to maintain a high roundness of an end surface of the electrode at which an electron lens is formed. Thus, by forming independently a portion of the electrode that is involved in forming an electron lens and the connecting member having the slit, and thereafter integrating the same, it is possible to prevent the distortion of the electron lens due to the deformation of an electrode forming the electron lens. According to the present invention, the roundness of an electrode forming a main electron lens exceeds 99.8[%], which is at the same level as that of an electrode without a slit. Therefore, an electron beam spot is not adversely affected by distortion of the electron lens.

The connecting member preferably is in a cylindrical shape whose cross-section taken along a plane perpendicular to the central axis is in a shape analogous to a shape of a cross section of the separated electrode.

According to the foregoing preferred configuration, the cross section of the separated electrode taken along a plane perpendicular to the central axis and that of the connecting member are analogous to each other. Therefore, it is possible to face and fix ends thereof with each other, or to insert one into the other and fix the same. Thus, the assembly of the electrode is facilitated.

The connecting member preferably includes two portions opposed to each other with a plane interposed therebetween, the plane being a plane including the central axis, or a plane parallel with the plane including the central axis.

Since the connecting member having the slit does not contribute to the formation of an electron lens, a high-precision forming process by deep-drawing, which results in the high production cost, is unnecessary. Therefore, by composing the connecting member of at least two portions with a plane including the central axis interposed therebetween, or with a plane parallel with the plane including the central axis interposed therebetween, as in the foregoing preferred configuration, it is possible to form the connecting member by a simple pressing process instead.

The support portions preferably are provided integrally with the two portions of the connecting member, respectively.

In an electrode formed by the conventional deep-drawing process, a support portion separately formed is fixed to a side of an electrode in a cylindrical shape by welding. In contrast, in the preferred configuration of the present invention, by composing the connecting member of two portions, it is possible to form the support portions and the connecting member by a simple pressing process so that they are provided integrally. This reduces the number of constituent components, thereby allowing for the lower-cost production. Furthermore, the welded portions conventionally cause the generation of foreign matters and the unnecessary discharge in the cathode-ray tube, but the number of welded portions can be decreased in the present invention. Furthermore, this reduces the cost.

The two portions of the connecting member preferably are coupled with each other by a coupling portion that is provided integrally with the connecting member at an end of the connecting member in a direction of the central axis.

According to the foregoing preferred configuration, it is possible to form the two portions of the connecting member as one component by a simple pressing process at a lower cost. Therefore, it is possible to decrease the number of the constituent components, and hence, to reduce the cost further.

The coupling portion preferably is provided integrally with the support portions at an end of each support portion in the central axis direction.

By providing the coupling portion integrally with the support portions, it is possible to form the connecting member in a cylindrical shape by only bending portions connecting the coupling portion with the support portions. Thus, the formation of the connecting member is facilitated.

It is preferable that an inner diameter of the cross section perpendicular to the central axis of the connecting member substantially is equal to an outer diameter of the electrode separated into two pieces, that ends of the two pieces of the separated electrode are inserted into ends of the connecting member in a direction of the central axis, respectively, and that the connecting member is conductive with the separated electrode.

According to the foregoing preferred configuration, the connecting member formed in an approximate cylindrical shape by bending is configured so as to catch the pieces of the electrode inserted into ends of the connecting member and fix the same. Therefore, the fixing of the foregoing members is facilitated. Furthermore, by providing the support portions in the connecting member, it is unnecessary to provide support portions on the pieces of the electrode at the ends of the connecting member.

It is preferable that the support portions include basal portions extending to ends of the two portions of the connecting member in a circumferential direction, respectively, and flat plate portions that are connected with the basal portions, respectively, and that are substantially parallel with the plane including the central axis. Besides, a relationship expressed as $Dc<0.8$ [mm]$<Ds$ preferably is satisfied, where Dc and Ds represent distances between the two support portions opposed to each other with the plane including the central axis interposed therebetween, Dc being a distance therebetween at a position where the basal portions are opposed to each other, and Ds being a distance therebetween at a position where the flat plate portions are opposed to each other.

In the case where the connecting member is composed of two portions and support portions are provided integrally with the two portions, a great distance Dc between the opposed support portions at the basal portions leads to the charging of the support rod as insulators. Then, an electric field generated therefrom passes through a gap at the basal portions thereby affecting the electron beam that passes through the inside. This causes the electron beam spot observed on the phosphor surface to be deformed in shape, thereby adversely affecting the resolution. This influence becomes remarkable when the distance at the basal portions exceeds 0.8 [mm]. On the other hand, the distance Ds between the opposed support portions at the flat plate portions preferably is greater than 0.8 [mm] since an excessively small distance Ds weakens the fixing of the connecting member to the support rod. In other words, by bending the basal portions of the opposed support portions in directions such that they approach each other so as to satisfy $Dc<0.8$ [mm]$<Ds$, it is possible to obtain a configuration that is not likely to be influenced by variation of the potential caused by the charging of the support rod.

Furthermore, a method for manufacturing the above-described electron gun for a cathode-ray tube according to the present invention includes: punching and pressing a plate material to form the two portions of the connecting member, the coupling portion, and the support portions so that they are provided integrally, to form the slit in the connecting member, and to form the two portions of the connecting member in a predetermined curved shape; bending the plate material at borders between the support portions and the coupling portion so that each of angles formed between the support portions and the coupling portion is approximately 90°, so that the two portions of the connecting member are opposed each other to form a cylindrical shape; inserting ends of the two pieces of the separated electrode into ends of the connecting member on both sides in the central axis direction, respectively, so that the connecting member and the electrode are conductive with each other; and fixing the support portions to the support rod. The punching and pressing, the bending, the inserting, and the fixing are carried out in the stated order.

By the foregoing method, the processing of the connecting member and the assembly of the electrode are facilitated.

DETAILED DESCRIPTION OF THE INVENTION

Figure 1:
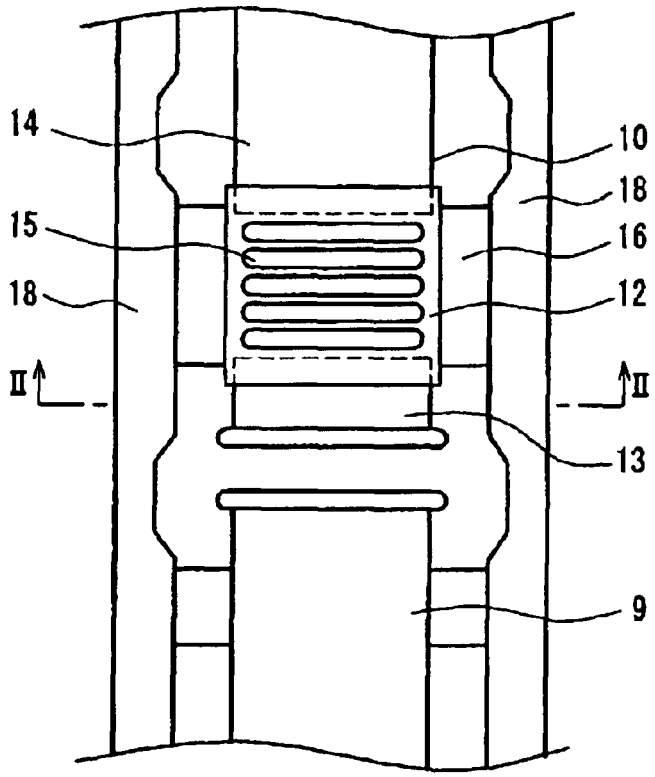
FIG. 1 is an enlarged side view of principal parts of an electron gun of the present invention.

The following will describe an embodiment in the case where an electron gun of the present invention is employed in a monochrome cathode-ray tube, while referring to the drawings.

Figure 3:
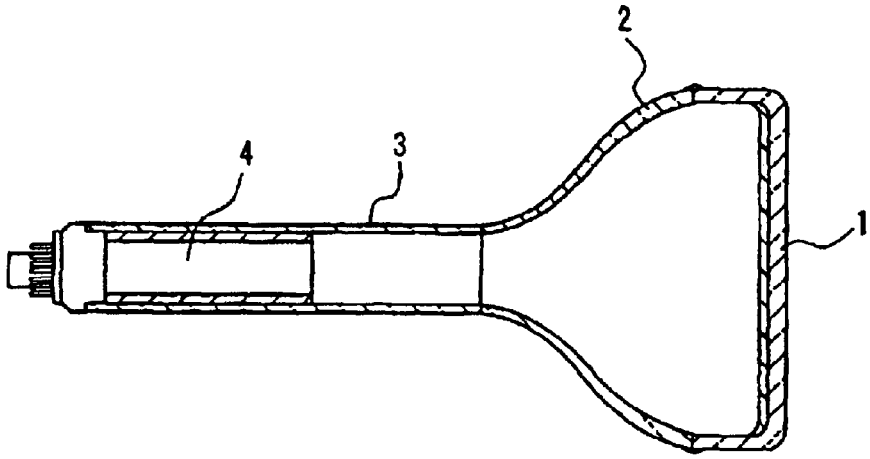
FIG. 3 is a schematic cross-sectional view of a cathode-ray tube.

FIG. 3 is a schematic cross-sectional view of a cathode-ray tube according to the present invention. The cathode-ray tube is a monochrome tube including a faceplate 1, a funnel 2, and a neck tube 3. An electron gun 4 is provided in the neck tube 3.

Figure 4:
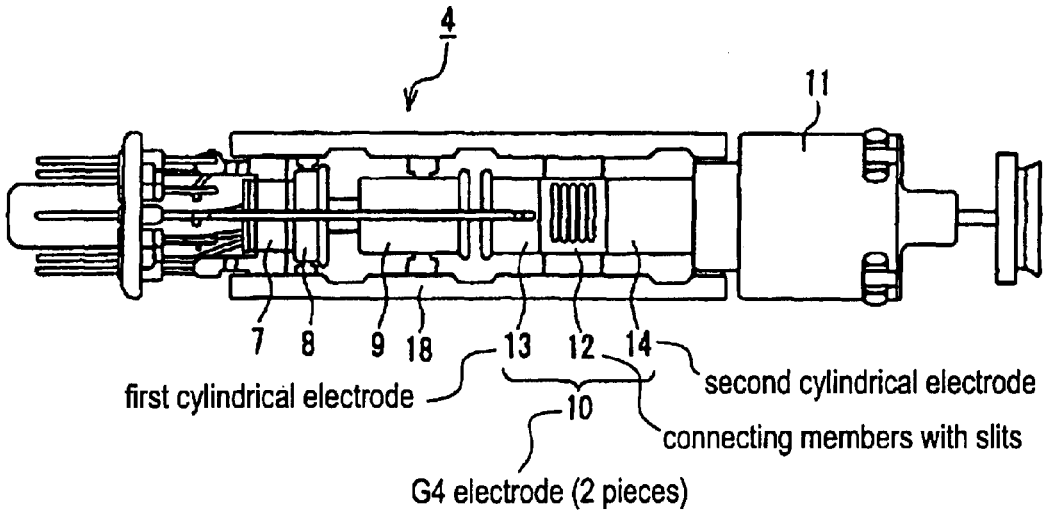
FIG. 4 is a side view of an electron gun of the present invention.

FIG. 4 is a side view of the electron gun according to the present invention. The electron gun 4 includes a GI electrode (control electrode) 7, a G2 electrode (accelerating electrode) 8, a G3 electrode (first anode electrode) 9, a G4 electrode (convergence electrode) 10, and a G5 electrode (second anode electrode) 11 that are arranged in the stated order, and that are fixed on support rods by means of support portions provided on their respective sides. The G1 electrode 7 is a cup-shaped electrode in which a cathode is housed. The G2 electrode 8 is a cup-shaped electrode whose bottom faces a bottom of the G1 electrode 7. The G3 electrode 9 is in a cylindrical shape and is located with a desired spacing from an opening of the G2 electrode 8. The G4 electrode 10 forms a main lens together with the G3 electrode 9. The G5 electrode 11 surrounds a tip of the G4 electrode 10. The G4 electrode 10 and the G5 electrode 11 together form an electron lens inside the G5 electrode 11.

The G4 electrode 10 is divided into two pieces, which are a first cylindrical electrode 13 and a second cylindrical electrode 14. Between these, a connecting member 12 having a plurality of slits is provided, via which the electric conductivity is achieved between the foregoing electrodes, and inside which an equipotential space is formed.

Figure 2:
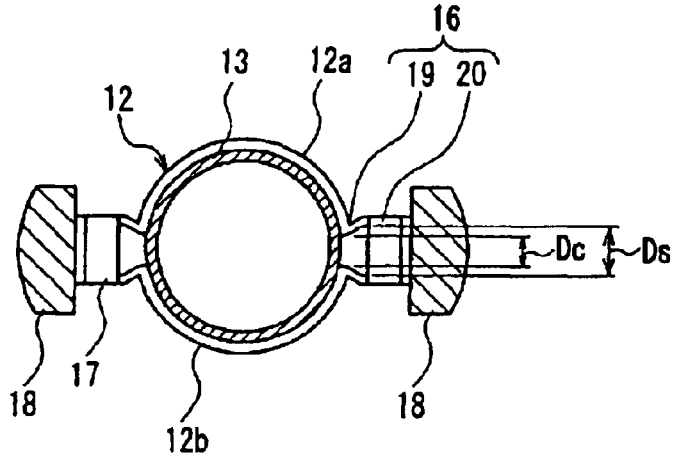
FIG. 2 is a cross-sectional view taken along a line II—II in FIG. 1, viewed in a direction indicated by the arrow.

FIG. 1 is an enlarged side view of the vicinity of the G4 electrode 10 and FIG. 2 is a cross-sectional view taken along a plane perpendicular to a central axis (a cross-sectional view taken along an arrow line II—II and viewed in a direction indicated by the arrows in FIG. 1). Here, the "central axis" refers to a central axis of the cylindrical electrodes, which substantially coincides with a tube axis of the cathode-ray tube or the electron gun. In the case of an in-line electron gun, the "central axis" refers to a central axis of an electron beam at the center. The connecting member 12 is in a cylindrical shape whose cross section is round, and has a plurality of slits 15 on its circumferential surface. The first cylindrical electrode 13 and the second cylindrical electrode 14 are inserted into both ends of the connecting member 12, respectively, and fixed therein by welding. On the circumferential surface of the connecting member 12, the connecting member 12 has support portions 16, which are fixed to two support rods 18, respectively. An internal diameter of the connecting member 12, an outer diameter of the first cylindrical electrode 13, and an outer diameter of the second cylindrical electrode 14 substantially are equal to one another.

As shown in FIG. 2, the connecting member 12 includes a first portion 12*a* and a second portion 12*b* that are opposed to each other with a plane including the central axis interposed therebetween. The support portions 16 extend from ends in the circumferential direction of the first and second portions 12*a* and 12*b*. Each support portion 16 is composed of a basal portion 19 at which the support portion 16 is connected to the connecting member 12, and a flat plate portion 20 that is connected with the basal portion 19 and that is substantially parallel to the plane including the central axis. The first and second portions 12*a* and 12*b* are coupled with each other by coupling portions 17, each of which is provided at an end in the central axis direction of each support portion 16, thereby being formed into a single member.

The basal portions 19 of the opposed support portions 16 are bent in directions such that the basal portions 19 approach to each other, to cause the electron beam to be affected by a minimum of influence of potential variation due to the charging of the support rods 18 as insulators. A length Dc in FIG. 2 is indicative of a distance between the basal portions 19, and a length Ds therein is indicative of a distance between the flat plate portions 20.

Figure 5:
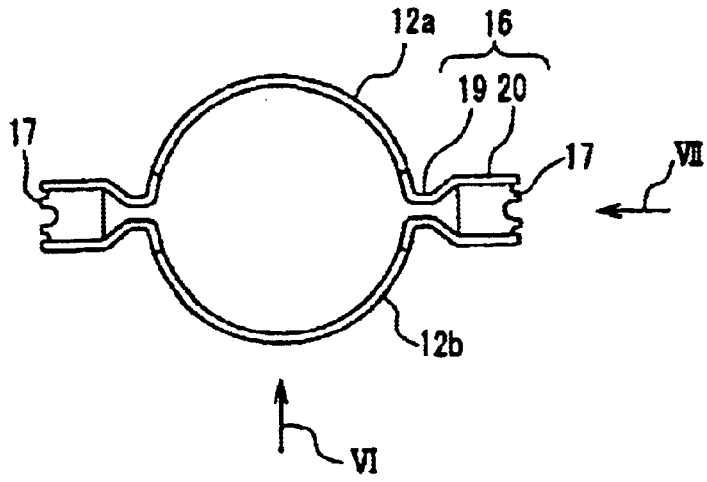
FIG. 5 is a view illustrating a connecting member according to the present invention.
Figure 6:
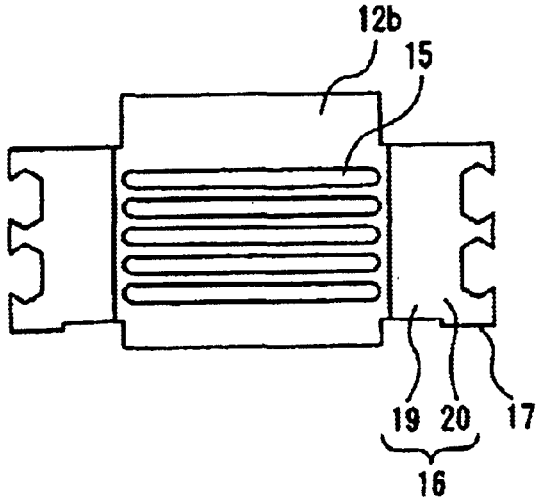
FIG. 6 is a bottom view of the connecting member of the present invention viewed in a direction indicated by an arrow VI in FIG. 5.
Figure 7:
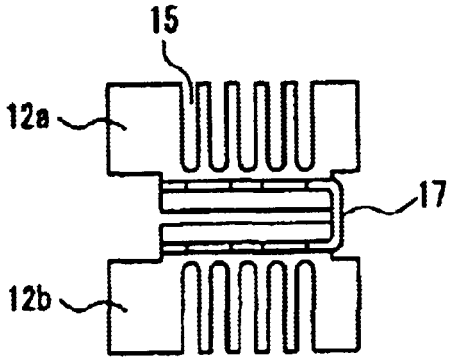
FIG. 7 is a side view of the connecting member of the present invention viewed in a direction indicated by an arrow VII in FIG. 5.

FIGS. 5 to 7 are views of the connecting member 12 viewed in different directions, respectively. FIG. 5 is a view of the same viewed in the tube axis direction from a side opposite to the coupling portions 17. FIG. 6 is a bottom view of the same viewed in a direction indicated by an arrow VI in FIG. 5. FIG. 7 is a side view of the same viewed in a direction indicated by an arrow VII in FIG. 5.

In the foregoing configuration, even if the cylindrical electrode is divided into two, it is possible to suppress an increase in the number of constituent components that could affect the cost significantly, since the connecting member 12 is provided integrally with the support portions 16. Furthermore, four welding positions in total suffice for the welding of the G4 electrode (welding of the cylindrical electrodes 13 and 14 with the first portion 12*a* and welding of the cylindrical electrodes 13 and 14 with the second portion 12*b*). Therefore, it is possible to suppress an increase in the number of welding positions that could affect the cost significantly, as well as the generation of foreign matters and the discharge in the cathode-ray tube.

The following will describe a preferred embodiment in the case where the present invention is applied to a monochrome cathode-ray tube for a projection tube having a diagonal of 16 [cm] (7 inches) and a neck tube diameter of ϕ29.1 [mm].

The slit-provided connecting member 12 is made of stainless steel as a raw material, and has a length in the central axis direction of 10 [mm], an internal diameter of 10.4 [mm], and five slits 15 in each of the two portions 12*a* and 12*b*, therefore ten in total, each slit 15 having a width of 0.6 [mm]. In this case, it is not desired that the width of the slit 15 exceeds 0.8 [mm], since if so the electron beam is likely to be affected by an external electric field.

Figure 13:
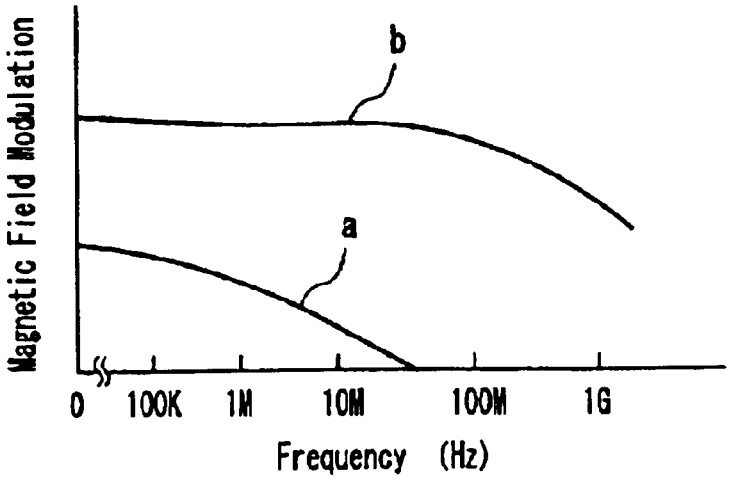
FIG. 13 is a view showing the comparison between the magnitude of the magnetic field modulation in the present invention and that in the conventional example.
Figure 14:
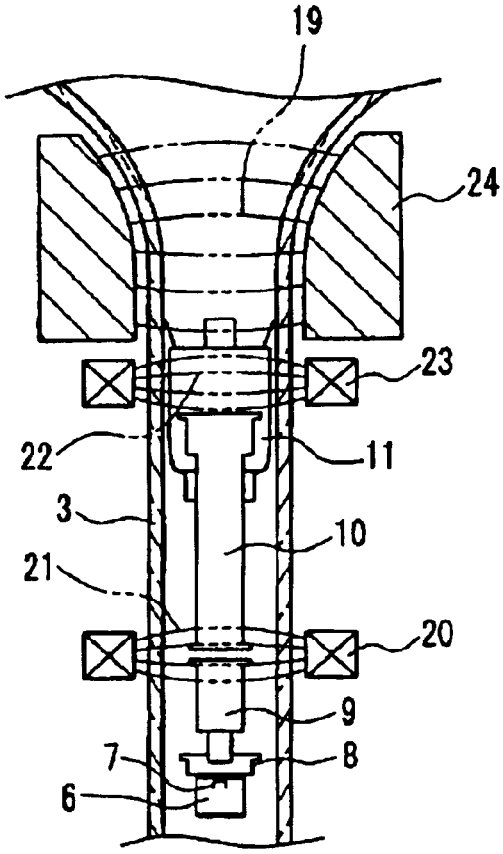
FIG. 14 PRIOR ART
FIG. 14 is an enlarged side cross-sectional view of a neck portion of a conventional cathode-ray tube.

FIG. 13 is a graph illustrating the effect of the present invention, in which shown is the relationship between the frequency of the modulation magnetic field (horizontal axis) and the magnetic field modulation (vertical axis). Here, the "magnetic field modulation" indicates, when a rectangular signal as an image signal for displaying a vertical stripe on the phosphor screen is supplied to the cathode-ray tube, a difference between widths of vertical stripes on the phosphor screen when the velocity modulation is applied and when the velocity modulation is not applied. A greater difference indicates that the magnetic field modulation has a more significant effect. In FIG. 13, a curve a indicates a case of a conventional electron gun without the slits 15, and a curve b indicates a case of the electron gun of the present invention. It can be seen from the same that with the electron gun of the present invention, it is possible to obtain an increased effect of the magnetic field modulation in a wider frequency band as compared with the conventional case.

As described above, in the case where the gap Dc between the basal portions 19 of the connecting member is great, the support rods 18, which are insulators, are charged, and an electric field generated therefrom penetrates inside through the gap Dc, thereby affecting the electron beam that passes through the inside. This causes the electron beam spot observed on the phosphor surface to be deformed in shape, thereby adversely affecting the resolution. This influence becomes remarkable when the gap Dc exceeds 0.8 [mm]. On the other hand, the distance Ds between the flat plate portions 20 preferably is greater than 0.8 [mm] since an excessively small distance Ds weakens the fixing of the connecting member 12 to the support rods. By bending the basal portions 19 of the support portions 16 in opposite directions such that they approach to each other to satisfy Dc<0.8 [mm]<Ds, it is possible to obtain a configuration that is not likely to be influenced by variation of the potential caused by the charging of the support rods.

The following will describe a method for manufacturing the connecting member 12.

FIGS. 8 to 11 illustrate how the connecting member 12 is formed through respective steps of a manufacturing process of the present invention.

Figure 8:
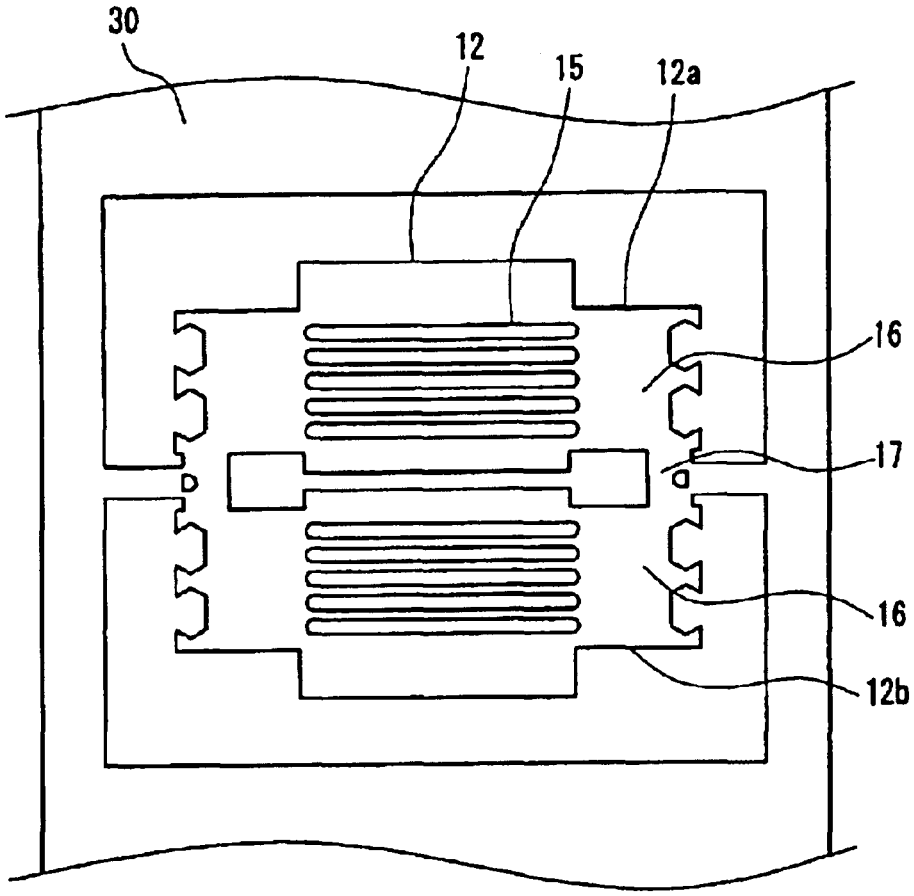
FIG. 8 is a view illustrating a step of a manufacturing method of the present invention.

First of all, as shown in FIG. 8, a belt-like plate material 30 (ends of the same on both sides are omitted in the drawing, as indicated with wobbled lines) is subjected to punching. The two portions 12*a* and 12*b* of the connecting member 12, the coupling portions 17, and the support portions 16 are formed integrally, and the slits 15 are formed in the two portions 12*a* and 12*b* of the connecting member 12. This step may be divided into a plurality of steps so that the punching of the slits 15, the punching of holes between the two portions 12*a* and 12*b*, and the punching of the two portions 12*a* and 12*b* may be carried out separately.

Figure 9:
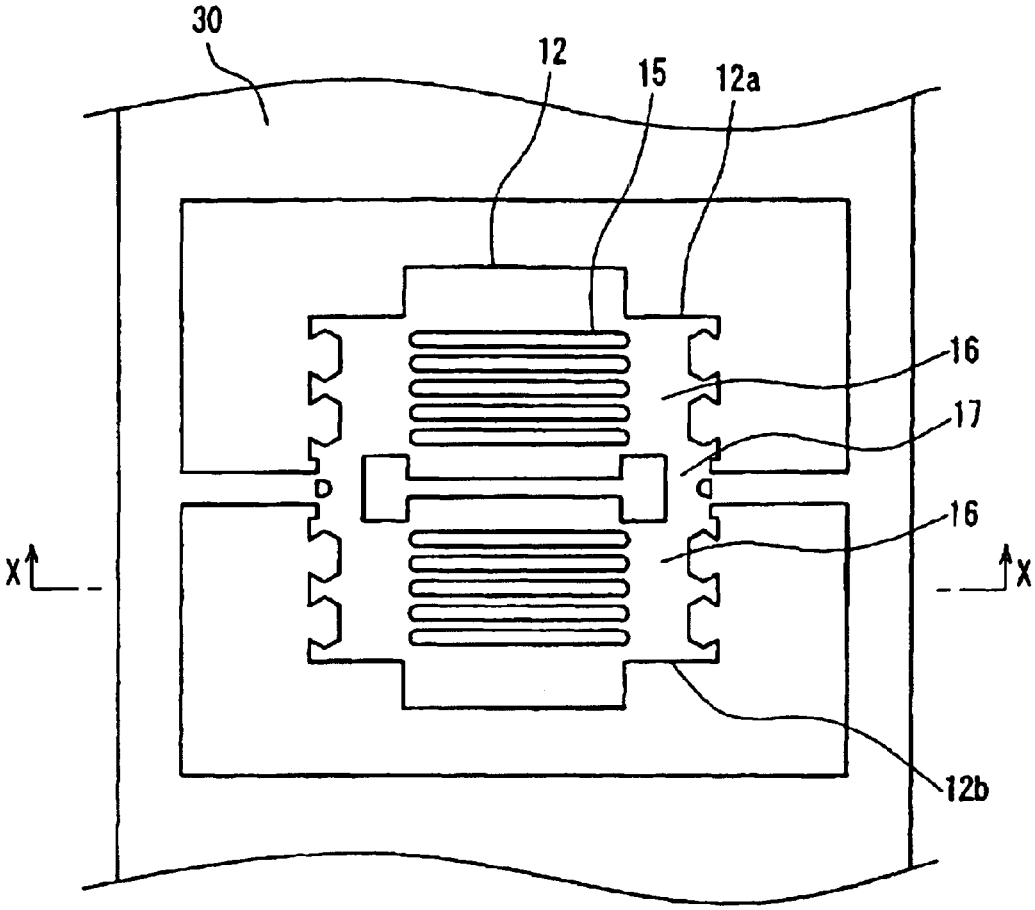
FIG. 9 is a view illustrating another step of the manufacturing method of the present invention.
Figure 10:
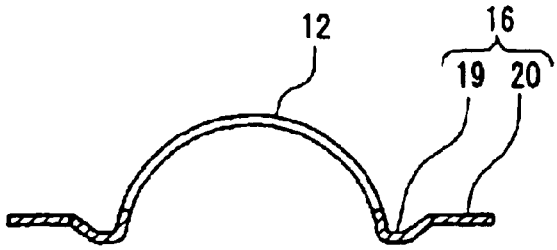
FIG. 10 is a cross-sectional view taken along a line X—X in FIG. 9, viewed in a direction indicated by the arrow.

Next, as shown in FIG. 9, a semicircular bending step is carried out. The two portions 12*a* and 12*b* of the connecting members 12 are formed by pressing so as to be curved desirably (in a substantially semicircular arc), and the basal portions 19 and the flat plate portions 20 are formed in the support portions 16. FIG. 10 illustrates a cross section of the same taken along a line X—X in FIG. 9, viewed in a direction indicated by the arrows. This step may be divided further into a plurality of steps so that the bending of the basal portions 19 and the bending of the two portions 12*a* and 12*b* may be carried out separately. Alternatively, the bending may be carried out concurrently with the foregoing punching.

Figure 11:
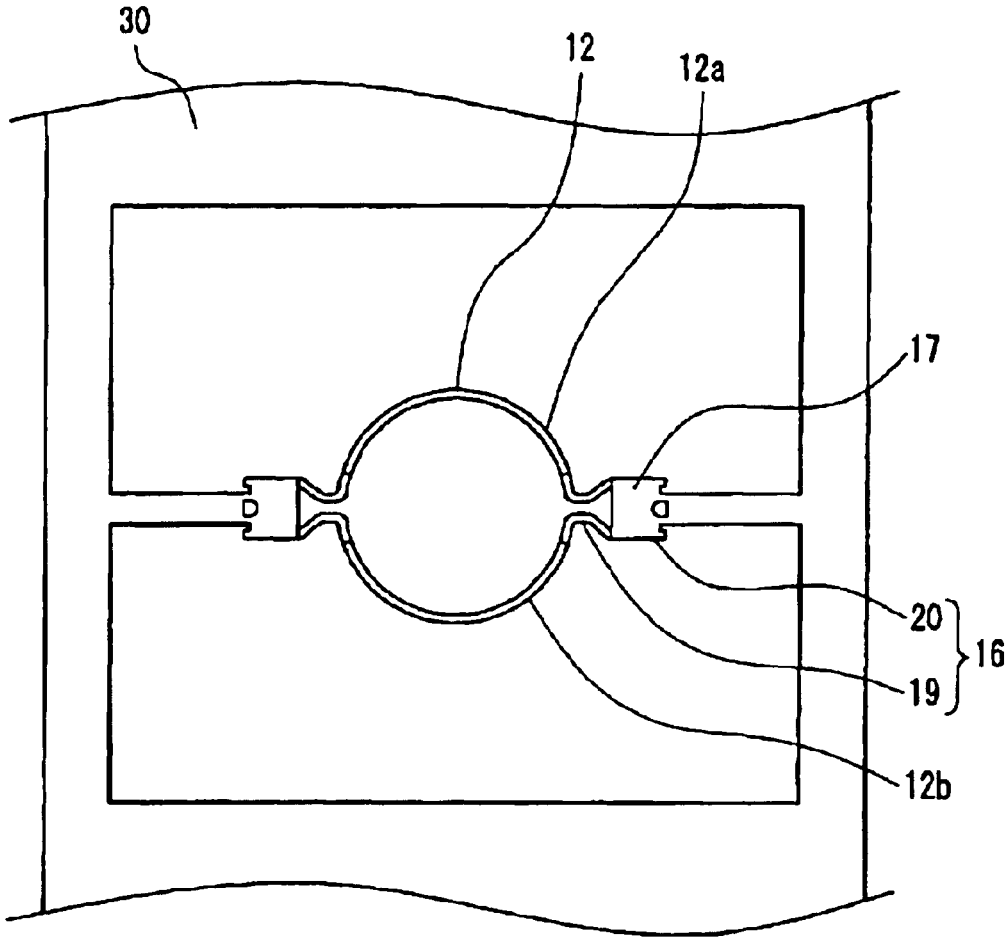
FIG. 11 is a view illustrating still another step of the manufacturing method of the present invention.

Next, as shown in FIG. 11, a step of bending into an angular U shape is carried out. The thus processed material is bent at borders between the support portions 16 and the coupling portions 17 so that each of angles formed between the coupling portions 17 and the support portions 16 integrally provided with the two portions 12*a* and 12*b* of the connecting member 12 is approximately 90°. By so doing, the two portions 12*a* and 12*b* of the connecting member 12 are opposed to each other so as to be formed in an approximately cylindrical shape.

Finally, a cutting step is carried out. The connecting member 12 is cut away from the plate material 30 at ends of the coupling portions 17, whereby the connecting member 12 is finished.

Figure 12:
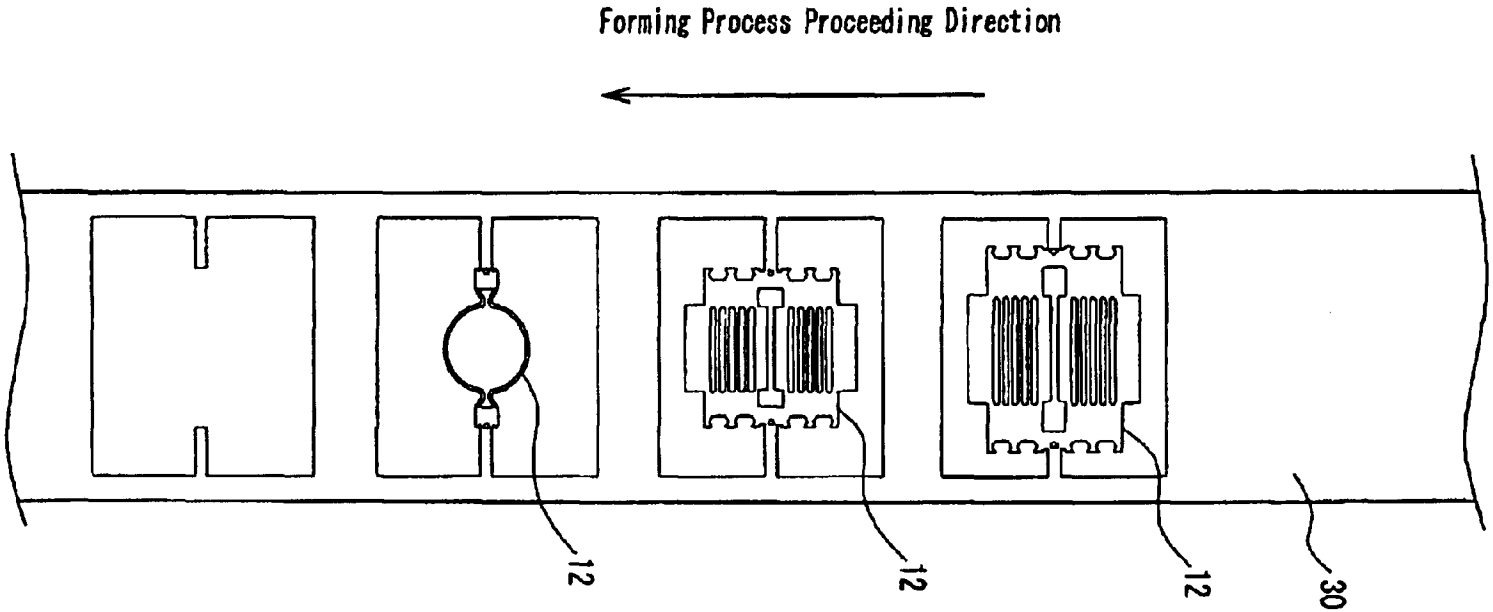
FIG. 12 is a view illustrating the successive steps of the manufacturing method of the present invention.

FIG. 12 is a view illustrating the foregoing forming process in which the successive steps are shown in series. The drawing illustrates how the punching, the semicircular bending, the angular-U-shape bending, and the cutting are carried out while the belt-like plate material 30 is transported in a direction indicated by an arrow.

Ends of the electrodes 13 and 14 separated are inserted into ends on both sides in the central axis direction of the connecting member 12 thus finished, and are subjected to welding. Then, their support portions, as well as the other electrodes, are fixed to the support rods, whereby the electron gun is completed.

So far, the case where the present invention is applied to the monochrome cathode-ray tube is described, but the present invention can be applied to a color cathode-ray tube as well. In the case where the present invention is applied to an in-line electron gun, the connecting member provided with slits may be configured so as to have a cylindrical shape with an elliptic cross section. Besides, a position at which the connecting member provided with slits is located is not limited to the position where the velocity modulation coil is disposed. The connecting member may be disposed at a position where the permeation of a magnetic field from another coil is improved, or at a position where the generation of heat by an external magnetic field is reduced.

The embodiment of the present invention described above is excellent in that the connecting member can be manufactured readily, but the present invention is not necessarily limited to the foregoing embodiment, from the viewpoint of the improvement of the roundness of the electrodes, the reduction of eddy current loss, etc.

The connecting member may be in a cylindrical shape whose cross section taken along a plane perpendicular to the central axis has an analogous shape to a shape of a cross section of separated electrodes. Furthermore, the connecting member is not limited to a member composed of two parts opposed to each other with a plane including the central axis interposed therebetween, but may be a member composed of not less than three parts. Furthermore, the connecting member is not necessarily in a cylindrical shape, but, for instance, may be configured so that two separated electrodes are interposed between two flat plates provided with slits and the two flat plates are fixed to the support rods. In the case of an in-line electron gun in particular, its cross section taken along a plane perpendicular to the central axis of the electrodes is in an elliptic shape, and each electrode has two surfaces parallel with an in-line surface. Therefore, the electrodes can be interposed between the flat plates so that the flat plates are in contact with the foregoing two surfaces of each electrode and fixed.

The support portions may be configured as members separated from the connecting member, and may be fixed to the connecting member by welding or the like. The coupling portions may be configured as members separated from the support portions, and may be fixed to the support portions by welding or the like. Furthermore, the coupling portions are not necessarily indispensable, and the two portions composing the connecting member may be fixed independently to the electrodes and the support rods.

As described above, with the present invention, it is possible to provide a high-resolution electron gun for a cathode-ray tube with decreased resolution variation, which achieves a desired electron beam modulation effect without hindering the penetration of a modulation magnetic field from outside the cathode-ray tube, and does not generate distortion of an electron lens due to distortion of an electrode, thereby obtaining an excellent beam spot shape.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An electron gun for a cathode-ray tube, comprising a plurality of cylindrical electrodes arranged so that an electron beam passes through inside the electrodes, the electrodes being fixed to a support rod, wherein at least one of the electrodes is separated into at least two pieces that are spaced from each other in a direction parallel to a central axis of the electrode, a connecting member having a slit is provided between the pieces of the separated electrode, the pieces of the separated electrode are in electrical contact with each other via the connecting member, and the pieces of the separated electrode are fixed to the support rod via the connecting member and support portions provided on a side of the connecting member.

2. The electron gun for a cathode-ray tube according to claim 1, wherein the connecting member is in a cylindrical shape whose cross-section taken along a plane perpendicular to the central axis is in a shape analogous to a shape of a cross section of the separated electrode.

3. The electron gun for a cathode-ray tube according to claim 1, wherein the connecting member includes two portions opposed to each other with a plane interposed therebetween, the plane being a plane including the central axis, or a plane parallel with the plane including the central axis.

4. The electron gun for a cathode-ray tube according to claim 3, wherein the support portions are provided integrally with the two portions of the connecting member, respectively.

5. The electron gun for a cathode-ray tube according to claim 3, wherein the two portions of the connecting member are coupled with each other by a coupling portion that is provided integrally with the connecting member at an end of the connecting member in a direction of the central axis.

6. The electron gun for a cathode-ray tube according to claim 5, wherein the coupling portion is provided integrally with the support portions at an end of the each support portion in the central axis direction.

7. The electron gun for a cathode-ray tube according to claim 1, wherein an inner diameter of the cross section perpendicular to the central axis of the connecting member substantially is equal to an outer diameter of the electrode separated into two pieces, ends of the two pieces of the separated electrode are inserted into ends of the connecting member in a direction of the central axis, respectively, and the connecting member is electrically conductive with the separated electrode.

8. The electron gun for a cathode-ray tube according to claim 4, wherein the support portions include basal portions extending to ends of the two portions of the connecting member in a circumferential direction, respectively, and flat plate portions that are connected with the basal portions, respectively, and that are substantially parallel with the plane including the central axis, and a relationship expressed as $Dc<0.8$ [mm]$<Ds$ is satisfied, where Dc and Ds represent distances between the two support portions opposed to each other with the plane including the central axis interposed therebetween, Dc being a distance therebetween at a position where the basal portions are opposed to each other, Ds being a distance therebetween at a position where the flat plate portions are opposed to each other.

9. A method for manufacturing the electron gun for a cathode-ray tube according to claim 6, the method comprising:

punching and pressing a plate material to form the two portions of the connecting member, the coupling portion, and the support portions so that they are provided integrally, to form the slit in the connecting member, and to form the two portions of the connecting member in a predetermined curved shape, bending the plate material at borders between the support portions and the coupling portion so that each of angles formed between the support portions and the coupling portion is approximately 90°, so that the two portions of the connecting member are opposed each other to form a cylindrical shape, inserting ends of the two pieces of the separated electrode into ends of the connecting member on both sides in the central axis direction, respectively, so that the connecting member and the electrode are conductive with each other, and fixing the support portions to the support rod, the punching and pressing, the bending, the inserting, and the fixing being carried out in the stated order.

* * * * *